US010589541B2

(12) United States Patent
Iijima et al.

(10) Patent No.: US 10,589,541 B2
(45) Date of Patent: Mar. 17, 2020

(54) PRINTER

(71) Applicant: Brother Kogyo Kabushiki Kaisha, Nagoya-shi, Aichi-ken (JP)

(72) Inventors: Shota Iijima, Nagoya (JP); Takanori Izumi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/234,882

(22) Filed: Dec. 28, 2018

(65) Prior Publication Data

US 2019/0263140 A1 Aug. 29, 2019

(30) Foreign Application Priority Data

Feb. 28, 2018 (JP) ..... 2018-034458

(51) Int. Cl.
*B41J 2/32* (2006.01)
*B41J 29/13* (2006.01)

(52) U.S. Cl.
CPC *B41J 2/32* (2013.01); *B41J 29/13* (2013.01)

(58) Field of Classification Search
CPC ... B41J 2/32; B41J 29/13; B41J 25/304; B41J 25/308; B41J 25/3082; B41J 25/3084; B41J 25/3086; B41J 25/3088; B41J 25/312; B41J 25/316
See application file for complete search history.

(56) References Cited

U.S. PATENT DOCUMENTS 5,366,302 A * 11/1994 Masumura ..... B41J 25/316 347/197
6,061,076 A * 5/2000 Ishii ..... B41J 11/04 347/197
8,436,880 B2 * 5/2013 Matsushima ..... B41J 2/32 347/197
8,553,058 B2 * 10/2013 Huang ..... B41J 2/32 347/198

FOREIGN PATENT DOCUMENTS

JP H06-286263 A 10/1994

* cited by examiner

*Primary Examiner* — Kristal Feggins
(74) *Attorney, Agent, or Firm* — Banner & Witcoff, Ltd.

(57) ABSTRACT

A printer includes: a head holder supporting a thermal head; a platen holder supporting a platen roller that presses a printing medium toward the thermal head; an engagement member movably supported by one of the platen holder and the platen roller and engageable with and removable from the head holder; and a moving mechanism configured to move the platen holder and the engagement member and configured to move the engagement member from a disengaged position at which the engagement member is separated from and not engaged with the head holder, to an engaged position at which the engagement member is located at and engaged with the head holder, in conjunction with moving the platen holder from a separated position at which the platen roller is separated from the head holder, to a pressing position at which the platen roller presses the printing medium against the thermal head.

17 Claims, 8 Drawing Sheets

PRINTER

CROSS REFERENCE TO RELATED APPLICATION

The present application claims priority from Japanese Patent Application No. 2018-034458, which was filed on Feb. 28, 2018, the disclosure of which is herein incorporated by reference in its entirety.

BACKGROUND

The following disclosure relates to a printer that uses a thermal head to perform printing.

There is known a printer configured to perform printing by heating a thermal head to transfer ink of an ink ribbon to a printing medium. The ink ribbon is pressed against the thermal head by a platen roller in a state in which the ink ribbon overlaps the printing medium. There is known a printer including a platen roll, a head opening/closing plate, a recording head, a fixed shaft, and a correcting support member. The platen roll is supported by a frame via a platen roll shaft. The correcting support member is rotatably supported by the platen roll shaft. The head opening/closing plate is pivotable and supports the recording head and the fixed shaft. The fixed shaft is disposed on an opposite side of the recording head from the platen roll in a state in which the head opening/closing plate has pivoted to a position at which the recording head is opposed to the platen roll. For example, in the case where the correcting support member is rotated by a user in this state, a cutout formed in the correcting support member is fitted on the fixed shaft. This corrects a positional relationship between the recording head and the platen roll.

SUMMARY

In order to change the printer to a printable state, a user needs to cause pivotal movement of the head opening/closing plate to oppose the recording head to the platen roller, and then rotate the correcting support member to fit the cutout onto the fixed shaft. That is, the user needs to perform a plurality of operations to establish the printable state of the printer, leading to complicated operations unfortunately.

Accordingly, an aspect of the disclosure relates to a printer that facilitates an operation for establishing a printable state of the printer In one aspect of the disclosure, a printer includes: a head holder configured to support a thermal head configured to perform printing on a printing medium; a platen holder configured to support a platen roller such that the platen roller is rotatable about a support shaft extending in a first direction orthogonal to a conveying direction in which the printing medium is conveyed during printing, the platen roller being configured to press the printing medium toward the thermal head, the platen holder being movable in a second direction orthogonal to the first direction and intersecting the conveying direction; an engagement member movably supported by one of the platen holder and the platen roller and engageable with and removable from the head holder; and a moving mechanism configured to move the platen holder and the engagement member and configured to move the engagement member from a disengaged position at which the engagement member is separated from and not engaged with the head holder, to an engaged position at which the engagement member is located at and engaged with the head holder, in conjunction with moving the platen holder in the second direction from a separated position at which the platen roller is separated from the head holder, to a pressing position at which the platen roller presses the printing medium against the thermal head.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

DETAILED DESCRIPTION OF THE EMBODIMENT

Figure 1:
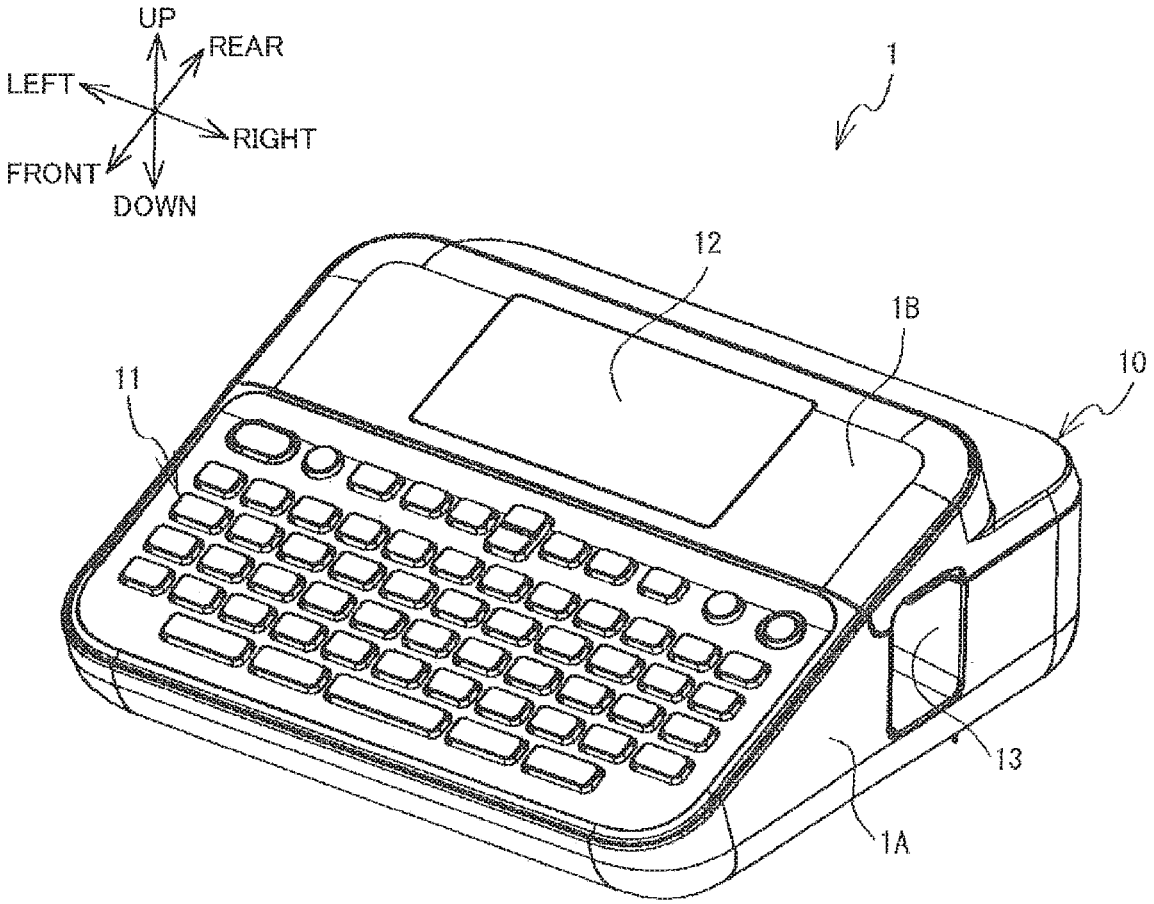
FIG. 1 is a perspective view of a printer, with a top cover being in a closed state.
Figure 2:
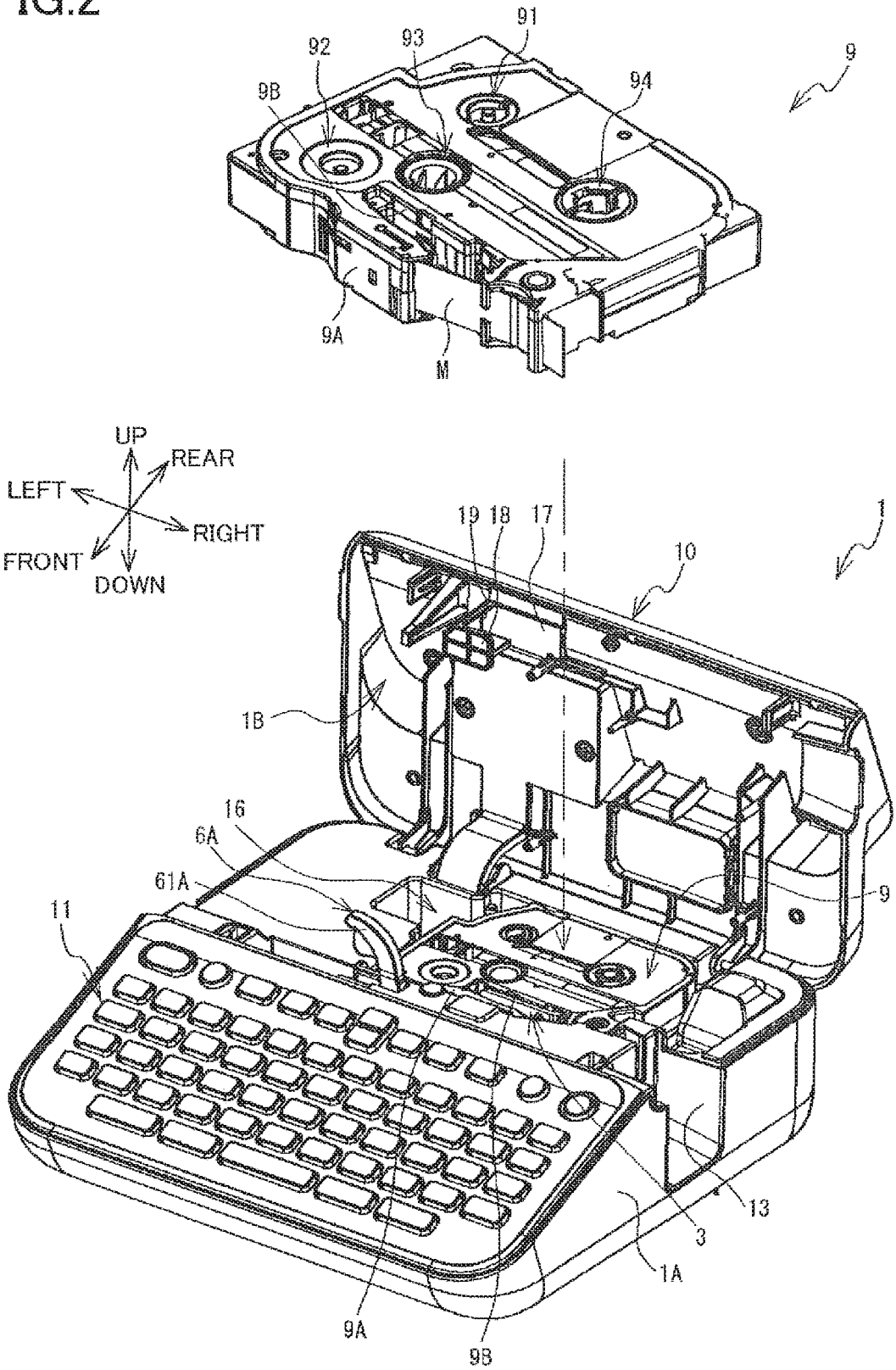
FIG. 2 is a perspective view of a cassette and the printer, with the top cover being in an open state.

Hereinafter, there will be described a printer 1 according to one embodiment by reference to the drawings. The printer 1 illustrated in FIG. 1 is a thermal printer of a thermal transfer type. The printer 1 performs printing by controlling a thermal head 3B (see FIG. 5A), which will be described below, to heat an ink ribbon to transfer ink to a printing medium. In the present embodiment, the printing medium is a laminate tape M (see FIG. 2). As illustrated in FIG. 2, the printer 1 is used in a state in which a cassette 9 is mounted in an accommodating portion 16. In the following description, the lower left side, the upper right side, the upper left side, the lower right side, the upper side, and the lower side in FIG. 1 are defined respectively as the front side, the rear side, the left side, the right side, the upper side, and the lower side of the printer 1. The directions for the printer 1 are applied to the cassette 9, assuming that the cassette 9 is mounted in the printer 1.

Overall Configuration of Printer 1

As illustrated in FIG. 1, the printer 1 includes a rectangular parallelepiped housing 10. The housing 10 includes a body cover 1A and a top cover 1B. A keyboard 11 for input of a character strings and so on is provided at a front portion of an upper surface of the body cover 1A. The keyboard 11 includes a power switch, application keys, cursor keys, and other similar keys. A right surface of the body cover 1A has an output opening 13 for discharging a printed tape, which will be described below, to the outside of the body cover 1A. As illustrated in FIG. 2, an opening is formed in a rear portion of the upper surface of the body cover 1A. The accommodating portion 16 for accommodating the cassette 9, which will be described below, is formed under the opening of the body cover 1A. The body cover 1A supports the top cover 1B pivotably at a rear end portion of the body cover 1A. The top cover 1B opens and closes the accommodating portion 16. FIG. 1 illustrates a state in which the top cover 1B closes the accommodating portion 16. FIG. 2 illustrates a state in which the top cover 1B opens the accommodating portion 16. As illustrated in FIG. 1, the top cover 1B is provided with a display 12 configured to display various kinds of information. A state of the top cover 1B closing the accommodating portion 16 will be hereinafter referred to as "closed state". A state of the top cover 1B opening the accommodating portion 16 will be hereinafter referred to as "open state". One of opposite surfaces of the top cover 1B, on which the display 12 is provided will be hereinafter referred to as "front surface", and the other will be hereinafter referred to as "back surface".

As illustrated in FIG. 2, the back surface of the top cover 1B is provided with a depressing portion 17 and a raising portion 18. The depressing portion 17 depresses a first lever member 6A while a user is closing the top cover 1B. The raising portion 18 raises the first lever member 6A while the user is opening the top cover 1B. The raising portion 18 is located to the right of a distal end of a standing wall 19 standing on a left end of the depressing portion 17. The depressing portion 17 and the raising portion 18 are substantially parallel with each other. The length of the raising portion 18 in the right and left direction is substantially half the length of the depressing portion 17 in the right and left direction. A contact portion 61A of the first lever member 6A is insertable into and removable from a space formed between the depressing portion 17 and the raising portion 18. The first lever member 6A and the contact portion 61A will be described later in detail.

Cassette 9

As illustrated in FIG. 2, the cassette 9 is shaped like a box having a substantially rectangular shape in plan view. A front surface portion of the cassette 9 includes an arm 9A protruding rightward in an arm shape. The arm 9A and a side wall portion of the cassette 9 forms a head opening 9B having a substantially U-shape in plan view. A head holder 3 is inserted into the head opening 9B in a state in which the head holder 3 is accommodated in the accommodating portion 16 of the printer 1.

The cassette 9 includes the supporters 91, 92, 93, 94. Though not specifically illustrated, the supporter 91 supports a laminate tape roll such that the laminate tape roll is rotatable. The tape roll is a roll of the transparent laminate tape M. The supporter 92 supports a ribbon roll such that the ribbon roll is rotatable. The ribbon roll is a roll of the ink ribbon having not been heated yet. The supporter 93 supports a take-up shaft such that the take-up shaft is rotatable. The take-up shaft takes up the ink ribbon after the heating. The supporter 94 supports an adhesive tape roll such that the adhesive tape roll is rotatable. The adhesive tape roll is a roll of the adhesive tape. The adhesive tape includes: a substrate; adhesive layers respectively provided on opposite surfaces of the substrate; a separation sheet stuck to a surface of one of the adhesive layers. The adhesive tape is rolled in a state in which the separation sheet is located on an outer side. The laminate tape M is one example of the printing medium.

The adhesive tape drawn from the adhesive tape roll extends frontward from the adhesive tape roll, is then bent rightward, and finally extends from the vicinity of a front right end portion of the cassette 9 in a direction in which the adhesive tape is discharged. The laminate tape M drawn from the laminate tape roll extends frontward from the laminate tape roll, is then bent rightward, and finally extends rightward through the arm 9A. The laminate tape M is discharged to the outside from a right end portion of the arm 9A and passes through a front portion of the head opening 9B. The laminate tape M is supported near the front right end portion of the cassette 9 and contacts a front surface of the adhesive layer of the adhesive tape. The laminate tape M is discharged from the cassette 9 in a state in which the adhesive tape is stuck to the laminate tape M. The ink ribbon drawn from the ribbon roll extends rightward from the ribbon roll through the arm 9A. The ink ribbon is discharged to the outside from the right end portion of the arm 9A and passes through the front portion of the head opening 9B. In this operation, the ink ribbon is located at the rear of the laminate tape M and conveyed parallel to the laminate tape M. The ink ribbon is separated from the laminate tape M at a position near the front right end portion of the cassette 9, then returned to the inside of the cassette 9, and taken up by the take-up shaft.

In the direction in which the laminate tape M extends, a direction directed at a position where the laminate tape M passes through the front portion of the head opening 9B and coinciding with a direction in which the laminate tape M is moved when the laminate tape M is drawn from the laminate tape roll may be hereinafter referred to as "conveying direction of the laminate tape M" or simply as "conveying direction". The conveying direction corresponds to the right direction in the printer 1 and the cassette 9. The direction reverse to the conveying direction corresponds to the left direction in the printer 1 and the cassette 9.

Frame 2

Figure 3A:
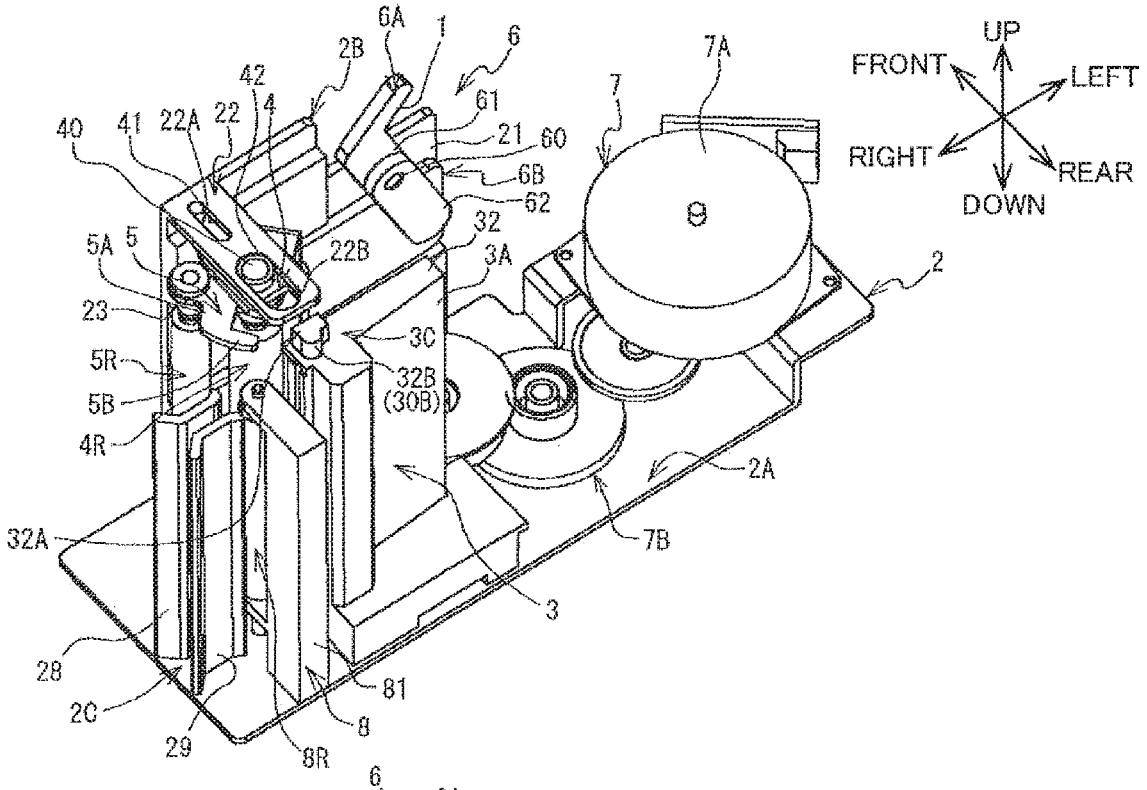
FIGS. 3A and 3B are perspective views of a frame (a first frame and a second frame), a head holder, a platen holder, an engagement member, and a moving mechanism viewed from a rear right side thereof.
Figure 3B:
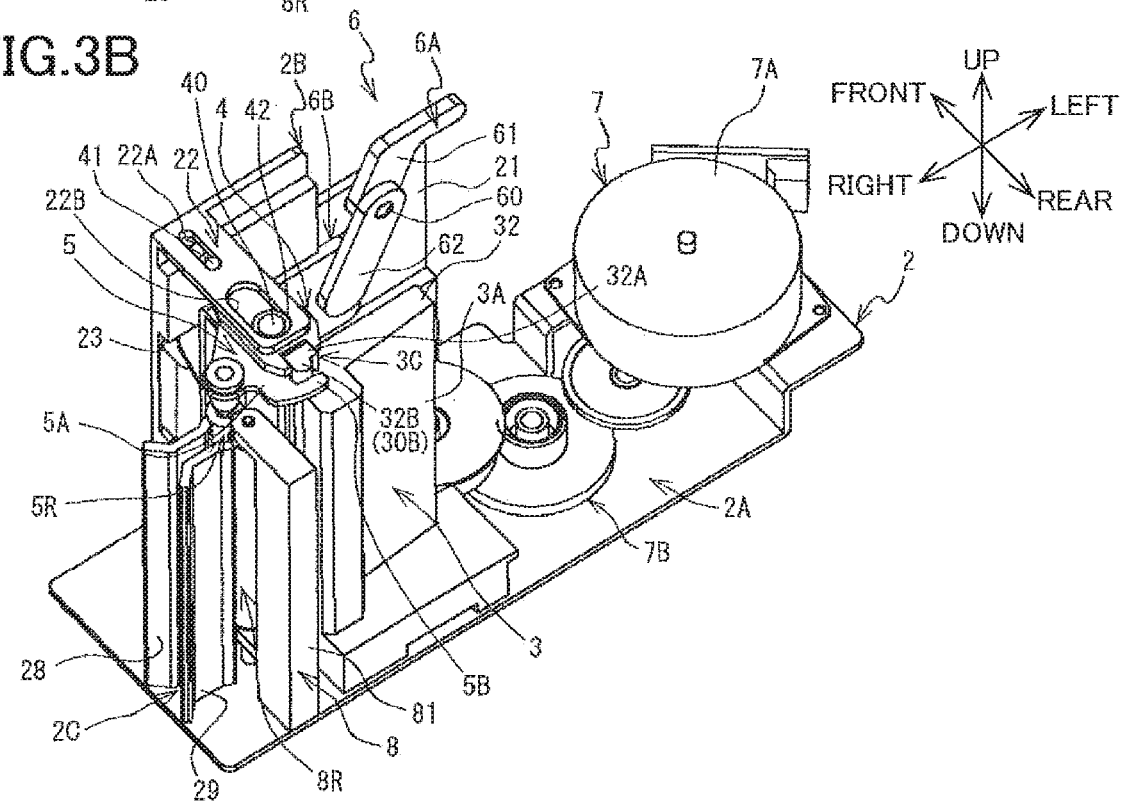

A frame 2 (see FIGS. 3A and 3B) is provided in the accommodating portion 16 of the printer 1. As illustrated in FIGS. 3A and 3B, the frame 2 (as one example of a conveying-direction-movement limiter and a second-direction-movement limiter) supports the head holder 3, a platen holder 4, an engagement member 5, a moving mechanism 6, a drive mechanism 7, a roller holder 8, and so on which will be described below. The head holder 3, the platen holder 4, the engagement member 5, the moving mechanism 6, the drive mechanism 7, and the roller holder 8 are supported by the housing 10 (see FIG. 1) via the frame 2. The frame 2 includes a first frame 2A and a second frame 2B.

As illustrated in FIGS. 3A and 3B, the first frame 2A is shaped like a plate. When viewed from above, the first frame 2A has a substantially rectangular shape elongated in the right and left direction. A left portion of the first frame 2A is bent in a substantially crank shape. An output unit 2C is provided near a right end portion of the first frame 2A and at a rear of the center of the first frame 2A in the front and rear direction. The output unit 2C is disposed to the left of the output opening 13 of the body cover 1A (see FIGS. 1 and 2) and to the right of the head holder 3 and the roller holder 8, which will be described below. The output unit 2C includes plates 28, 29 opposed to each other in the front and rear direction. The plates 28, 29 are bent and opposed to each other, with a space therebetween in the front and rear direction. The output unit 2C guides the printed tape, in which the printed laminate tape M and the adhesive tape are integrally stuck to each other, in the conveying direction to the output opening 13. The first frame 2A supports the head holder 3, the drive mechanism 7, the roller holder 8, and so on, which will be described below.

The second frame 2B is provided to the right of the center of the first frame 2A in the right and left direction. The second frame 2B includes a front plate 21 and an upper plate 22. The front plate 21 extends in a direction orthogonal to the front and rear direction and extends upward from a front end portion of the first frame 2A. A groove 23 extending in the right and left direction is formed in a rear surface of the front plate 21. A second lever member 6B of the moving mechanism 6, which will be described below, is fitted in the groove 23 from a rear side thereof.

The upper plate 22 extends rearward from a right end portion of an upper end portion of the front plate 21. The upper plate 22 has elongated holes 22A, 22B each extending in the front and rear direction. The elongated holes 22A, 22B are arranged next to each other in the front and rear direction. Each of the elongated holes 22A, 22B extends through the upper plate 22 in the up and down direction. The center line of the elongated hole 22A in the front and rear direction and the center line of the elongated hole 22B in the front and rear direction are located on the same straight line. The width of the elongated hole 22A in the right and left direction is less than the width of the elongated hole 22B in the right and left direction. The second frame 2B supports the platen holder 4, the engagement member 5, the moving mechanism 6, and so on, which will be described below.

Head Holder 3

The head holder 3 supports the thermal head 3B (see FIG. 5A) for performing printing on the laminate tape M. As illustrated in FIGS. 3A-4B, the head holder 3 includes a head supporter 3A secured to the first frame 2A of the frame 2 and extending in the up and down direction. As illustrated in FIGS. 5A and 5B, the thermal head 3B is provided on a front surface 31 of the head supporter 3A. The thermal head 3B is what is called a line thermal head including a multiplicity of heating elements arranged in a straight line in the up and down direction. It is noted that FIGS. 4A-5B omit illustration of the second frame 2B for easier understanding purposes.

As illustrated in FIGS. 5A and 5B, a lower plate 36 having a planar plate shape extends frontward from a position near a lower end of the head supporter 3A. The lower plate 36 is provided below the thermal head 3B. The lower plate 36 has a guide groove 36A extending in the front and rear direction. When viewed from above, the guide groove 36A has a U-shape. The guide groove 36A supports a lower holder portion 46 of the platen holder 4, which will be described below, such that the lower holder portion 46 is movable in the front and rear direction. When viewed from above, the center line of the guide groove 36A in the front and rear direction coincides with the center line of each of the elongated hole 22A and the elongated hole 22B in the front and rear direction.

Figure 7A:
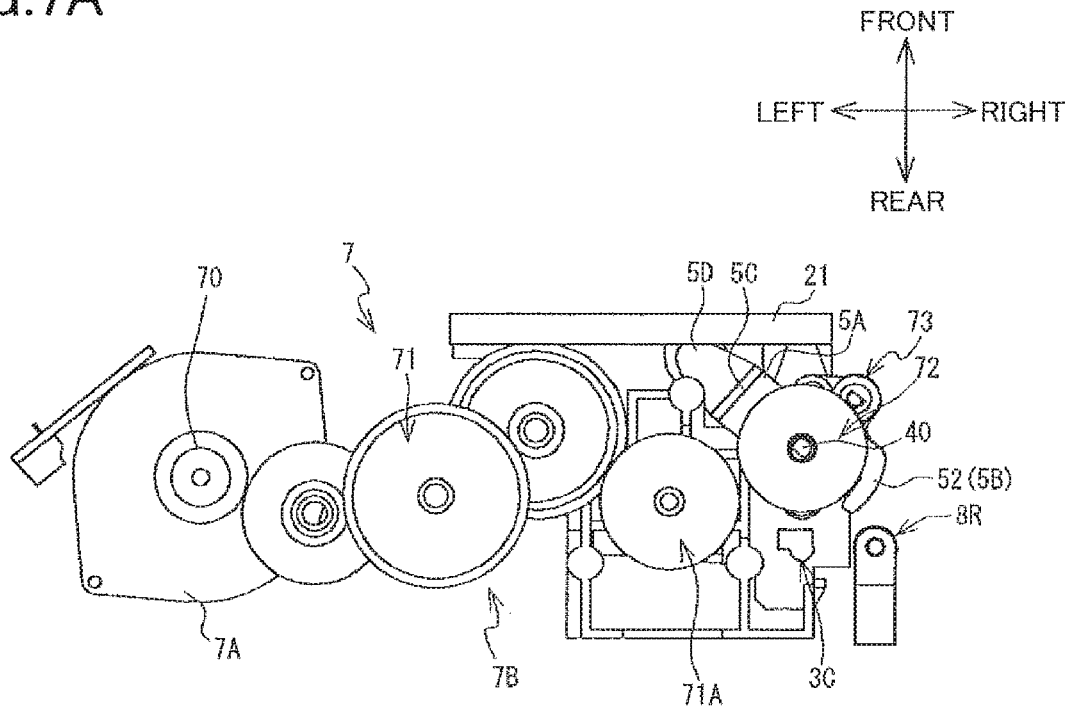
FIGS. 7A and 7B are views of a drive mechanism viewed from below.

As illustrated in FIGS. 3A and 3B, a projecting portion 3C protruding upward is provided on a right end portion of an upper surface 32 of the head supporter 3A. The projecting portion 3C includes a protruding portion 32A and an engaging protrusion 32B. The protruding portion 32A has a substantially rectangular parallelepiped shape. The engaging protrusion 32B is formed integrally with a rear end of the protruding portion 32A. When viewed from above, the engaging protrusion 32B protrudes so as to be curved rearward in an arc shape. As illustrated in FIG. 7A, a projecting portion 3C (a protruding portion 32A and an engaging protrusion 32B) having the same shape as that of the projecting portion 3C of the upper surface 32 protrudes downward from a lower surface (facing the first frame 2A) of the right portion of the head supporter 3A. The two engaging protrusions 32B provided on the respective upper and lower surfaces of the head supporter 3A will be hereinafter collectively referred to as "pair of protruding portions 30B".

Roller Holder 8

The roller holder 8 supports a sticking roller 8R capable of nipping the laminate tape M and the adhesive tape with a sub-roller 5R which will be described below. As illustrated in FIGS. 3A and 3B, the roller holder 8 is disposed to the right of the head holder 3. The roller holder 8 includes a supporter 81 shaped like a quadrangular prism extending upward from the first frame 2A of the frame 2. The supporter 81 includes extending portions extending frontward respectively from upper and lower end portions of the supporter 81. These extending portions support the sticking roller 8R such that the sticking roller 8R is rotatable. The sticking roller 8R has a circular cylindrical shape. The rotation center of the sticking roller 8R extends in the up and down direction. The sticking roller 8R is disposed to the left of left end portions of the respective plates 28, 29 in the output opening 13.

Platen Holder 4

The platen holder 4 supports a platen roller 4R which will be described below. The platen roller 4R presses the laminate tape M and the ink ribbon onto the thermal head 3B of the head holder 3. As illustrated in FIGS. 4A-5B, the platen roller 4R has a circular cylindrical shape. The center line 4X of the platen roller 4R extends the up and down direction orthogonal to the conveying direction (i.e., the right direction). Circular cylindrical support shafts 40 protrude respectively upward and downward from upper and lower end portions of the platen roller 4R. The center line of the support shafts 40 coincides with the center line 4X of the platen roller 4R.

The platen holder 4 includes: an upper holder portion 4A configured to support the upper support shaft 40 of the platen roller 4R such that the upper support shaft 40 is rotatable; and the lower holder portion 46 configured to support the lower support shaft 40 of the platen roller 4R such that the lower support shaft 40 is rotatable. That is, the platen roller 4R is rotatably supported by the upper holder portion 4A and the lower holder portion 46. The upper holder portion 4A is shaped like a plate elongated in the front and rear direction and extending in a direction orthogonal to the up and down direction. Bosses 41, 42 each protruding upward are provided on an upper surface of the upper holder portion 4A. The boss 41 has a circular cylindrical shape and is provided on a front end portion of the upper holder portion 4A. The boss 42 is provided at a rear of the center of the upper holder portion 4A in the front and rear direction. The boss 42 is shaped like a cylinder having a through hole of a round shape. The through hole of the boss 42 extends through the upper holder portion 4A in the up and down direction. The upper support shaft 40 of the platen roller 4R is inserted in the through hole of the boss 42. When viewed from above, the boss 42 is concentric with the support shafts 40 of the platen roller 4R. A rear end portion of the upper holder portion 4A has a recessed portion 43 that is recessed frontward.

As illustrated in FIGS. 3A and 3B, the boss 41 of the upper holder portion 4A is inserted, from below, in the elongated hole 22A formed in the upper plate 22 of the second frame 2B. The boss 42 of the upper holder portion 4A is inserted, from below, in the elongated hole 22B formed in the upper plate 22 of the second frame 2B. The upper holder portion 4A is movable in the front and rear direction with movement of the bosses 41, 42 along the respective elongated holes 22A, 22B. That is, the frame 2 limits movement of the platen holder 4 such that the platen holder 4 is movable in the front and rear direction. As illustrated in FIG. 5B, the lower holder portion 46 has a cylindrical shape and is movable in the front and rear direction along the guide groove 36A formed in the lower plate 36 provided on the head supporter 3A.

Figure 4A:
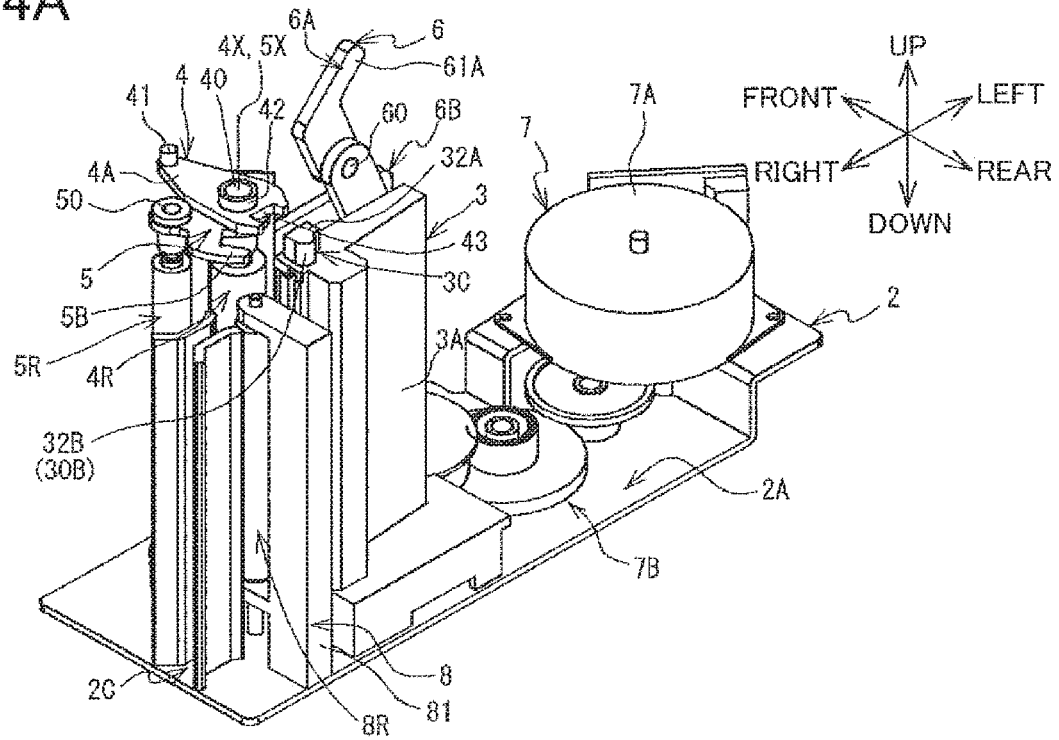
FIGS. 4A and 4B are perspective views of the frame (the first frame), the head holder, the platen holder, the engagement member, and the moving mechanism viewed from a rear right side thereof.
Figure 4B:
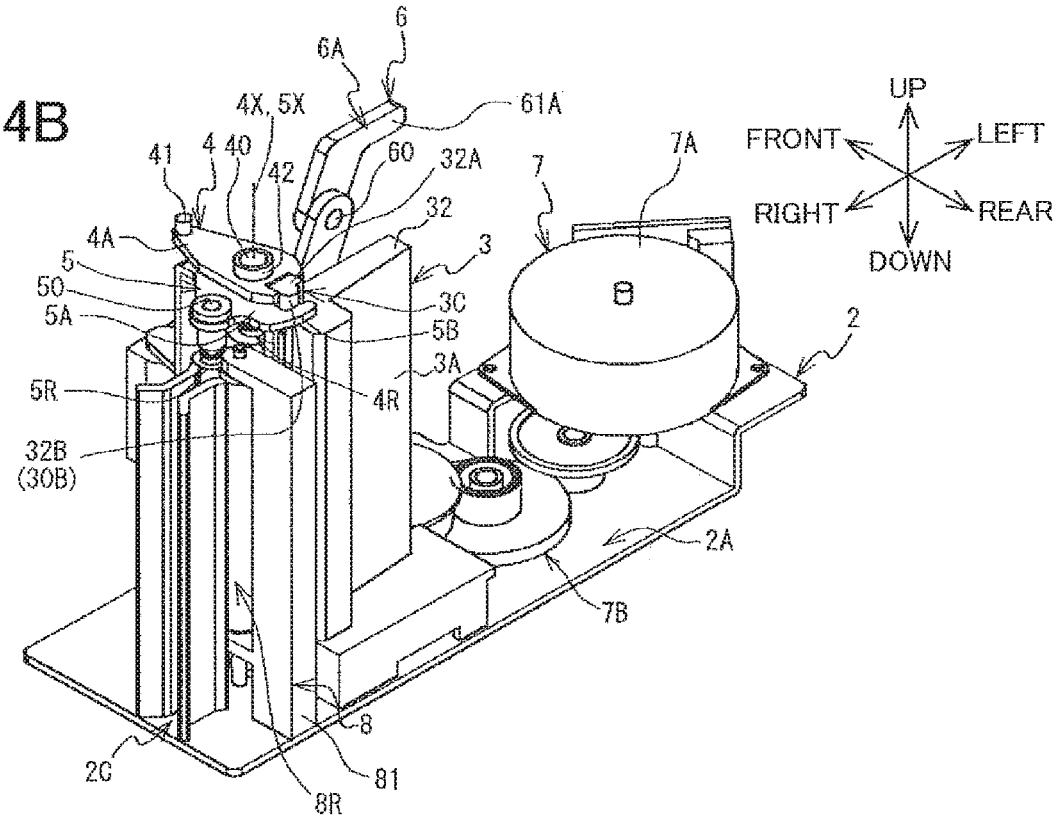
Figure 5A:
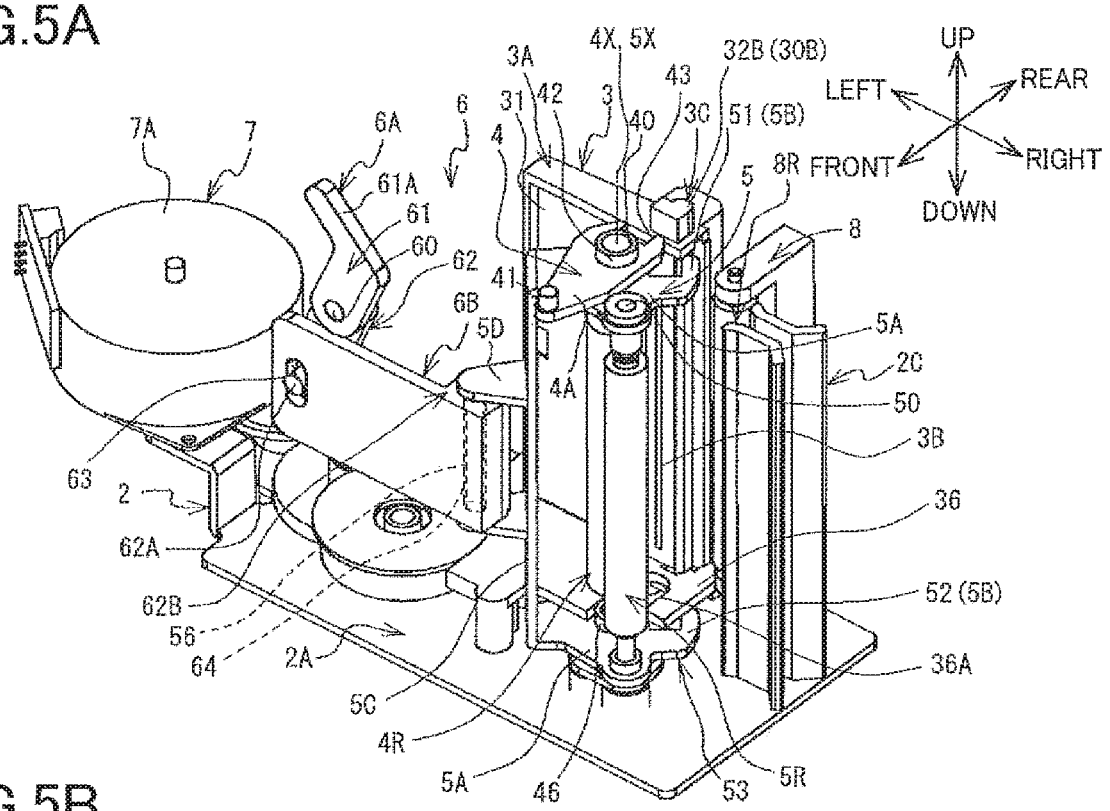
FIGS. 5A and 5B are perspective views of the frame (the first frame), the head holder, the platen holder, the engagement member, and the moving mechanism viewed from a front right side thereof.
Figure 5B:
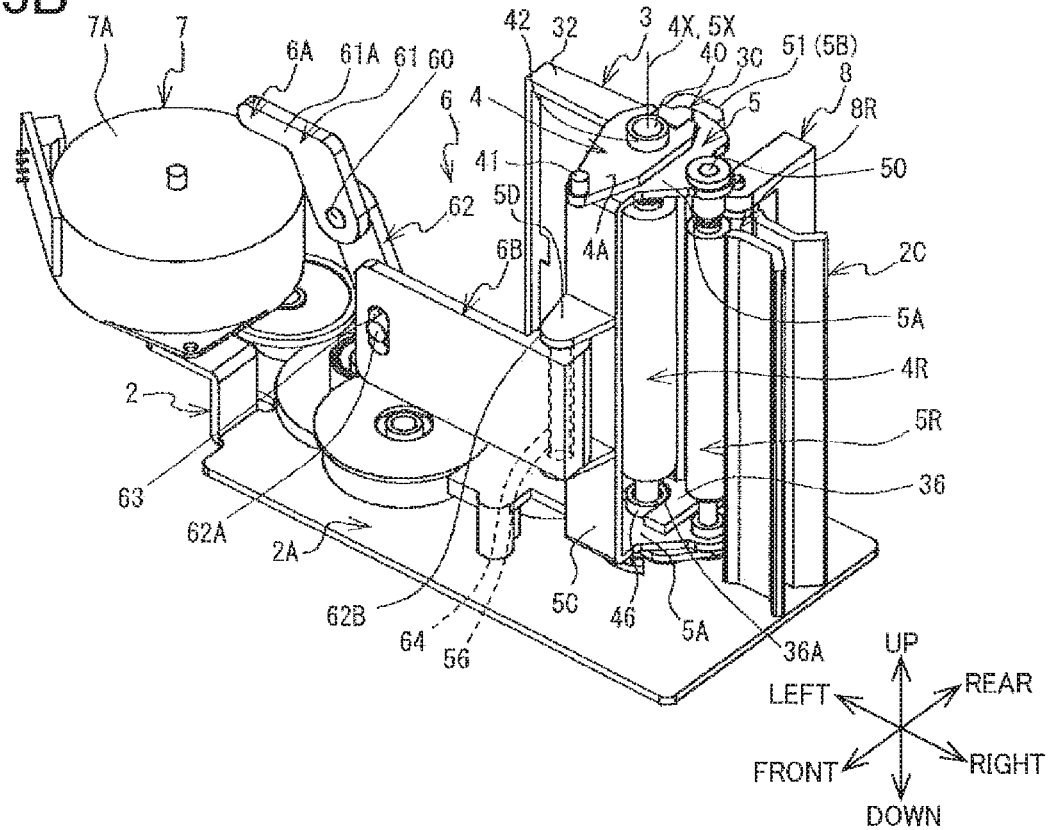

FIGS. 3A, 4A, 5A, 6A, 7A, and 8A (hereinafter may be referred to as "FIGS. 3A-8A") illustrate a state of the platen holder 4 in the case where the bosses 41, 42 are moved to front end portions of the respective elongated holes 22A, 22B. In this state, the platen roller 4R supported by the platen holder 4 is located in front of the head holder 3 with a space between the platen roller 4R and the head holder 3. Hereinafter, the position of the platen holder 4 in this state will be referred to as "separated position". As illustrated in FIG. 4A, when the platen holder 4 is located at the separated position, the recessed portion 43 formed in the upper holder portion 4A is located in front of the protruding portion 32A of the head holder 3 with a space between the recessed portion 43 and the protruding portion 32A.

FIGS. 3B, 4B, 5B, 6B, 7B, and 8B (hereinafter may be referred to as "FIGS. 3B-8B") illustrate a state of the platen holder 4 in the case where the bosses 41, 42 are moved to rear end portions of the respective elongated holes 22A, 22B. In this state, the platen roller 4R supported by the platen holder 4 is located near and in front of the thermal head 3B of the head holder 3 (see FIGS. 5A and 5B). Hereinafter, the position of the platen holder 4 in this state will be referred to as "pressing position". When the platen holder 4 is located at the pressing position, the platen roller 4R is capable of pressing the laminate tape M and the ink ribbon against the thermal head 3B. As illustrated in FIG. 4B, when the platen holder 4 is located at the pressing position, the recessed portion 43 of the upper holder portion 4A is engaged with the protruding portion 32A of the head holder 3 from a front side thereof. In the state in which the recessed portion 43 is engaged with the protruding portion 32A, a right end surface of the protruding portion 32A is in contact with a right end surface of the recessed portion 43, in other words, a surface of the recessed portion 43 which faces leftward. A left end surface of the protruding portion 32A is in contact with a left end surface of the recessed portion 43, in other words, a surface of the recessed portion 43 which faces rightward.

Engagement Member 5

The engagement member 5 is engaged with the head holder 3 in response to movement of the platen holder 4. As illustrated in FIGS. 5A and 5B, the engagement member 5 includes supporters 5A, engaging claws 5B, a side plate 5C, an arm 5D, and a second pin 56. The supporters 5A are provided respectively on upper and lower sides of opposite end portions of the platen roller 4R in the up and down direction. That is, the supporters 5A are provided as a pair. Each of the supporters 5A is shaped like a plate extending in a direction orthogonal to the up and down direction. Each of the supporters 5A has a through hole in which a corresponding one of the support shafts 40 is inserted. The upper supporter 5A is disposed under the upper holder portion 4A of the platen holder 4, and the lower supporter 5A is disposed under the lower holder portion 46. The upper supporter 5A is nipped between the upper holder portion 4A and the platen roller 4R in the up and down direction. Each of the engaging claws 5B is provided on one end portion of a corresponding one of the supporters 5A. The side plate 5C connects between the other end portions of the respective supporters 5A in the up and down direction.

The upper support shaft 40 of the platen roller 4R extends upward through the through hole of the upper supporter 5A and is inserted in the through hole of the boss 42 of the upper holder portion 4A. The lower support shaft 40 of the platen roller 4R extends downward through the through hole of the lower supporter 5A. As illustrated in FIGS. 3A and 3B, the pair of supporters 5A are movable in the front and rear direction in response to movement of the platen holder 4 between the separated position and the pressing position.

As illustrated in FIGS. 5A and 5B, the supporters 5A are pivotably supported by the respective support shafts 40 of the platen roller 4R. With this configuration, the engagement member 5 is pivotably supported by the platen roller 4R. In other words, the engagement member 5 is pivotably supported by the platen holder 4. The line segment extending along the pivotal center of the engagement member 5 will be hereinafter referred to as "pivotal center line 5X". The pivotal center line 5X extends in the up and down direction, and the pivotal center line 5X and the center line 4X of the support shafts 40 of the platen holder 4 are located on the same straight line. FIGS. 3A-8A illustrate a state of the engagement member 5 rotated most in the clockwise direction when viewed from above. The position of the engagement member 5 in this state will be hereinafter referred to as "disengaged position". FIGS. 3B-8B illustrate a state of the engagement member 5 rotated most in the counterclockwise direction when viewed from above. The position of the engagement member 5 in this state will be hereinafter referred to as "engaged position".

As illustrated in FIG. 5A, the engaging claws 5B include: a claw 51 provided on a one-side end portion of the upper supporter 5A; and a claw 52 provided on a one-side end portion of the lower supporter 5A. That is, the engaging claws 5B include a pair of the claws 51, 52. The claw 51 is disposed on the upper side of the platen roller 4R in the up and down direction. The claw 52 is disposed on the lower side of the platen roller 4R in the up and down direction. The claws 51, 52 will be hereinafter referred to as "pair of claws 53". As illustrated in FIGS. 3A-8A, the claws 53 are not engaged with the respective protruding portions 30B in a state in which the platen holder 4 is located at the separated position, and the engagement member 5 is located at the disengaged position. That is, the engaging claws 5B are separated from the head holder 3 and not engaged with the respective engaging protrusions 32B of the head holder 3. As illustrated in FIGS. 3B-8B, the claws 53 are engaged with the respective protruding portions 30B in a state in which the platen holder 4 is located at the pressing position, and the engagement member 5 is located at the engaged position. That is, the engaging claws 5B are engaged with the respective engaging protrusions 32B of the head holder 3.

As illustrated in FIGS. 5A and 5B, the pair of supporters 5A support the sub-roller 5R such that the sub-roller 5R is rotatable. The sub-roller 5R has a circular cylindrical shape. Circular cylindrical support shafts 50 protrude outward respectively from upper and lower end portions of the sub-roller 5R. The rotation center of the sub-roller 5R extends in the up and down direction along the support shafts 50. The sub-roller 5R is parallel with the sticking roller 8R. As illustrated in FIG. 5B, in the state in which the platen holder 4 is located at the pressing position, and the engagement member 5 is located at the engaged position, the sub-roller 5R is disposed to the right of the platen roller 4R, in other words, the sub-roller 5R is disposed downstream of the platen roller 4R in the conveying direction, and the sub-roller 5R is in contact with a front surface of the sticking roller 8R. With this configuration, the laminate tape M and the adhesive tape are nipped between the sub-roller 5R and the sticking roller 8R, and the adhesive tape is stuck to the printed laminate tape M. When the platen roller 4R and the sub-roller 5R are rotated, the printed tape in which the adhesive tape is stuck to the printed laminate tape M is conveyed in the conveying direction. As illustrated in FIG. 5A, the sub-roller 5R is separated from the front surface of the sticking roller 8R in the state in which the platen holder 4 is located at the separated position, and the engagement member 5 is located at the disengaged position.

Figure 6A:
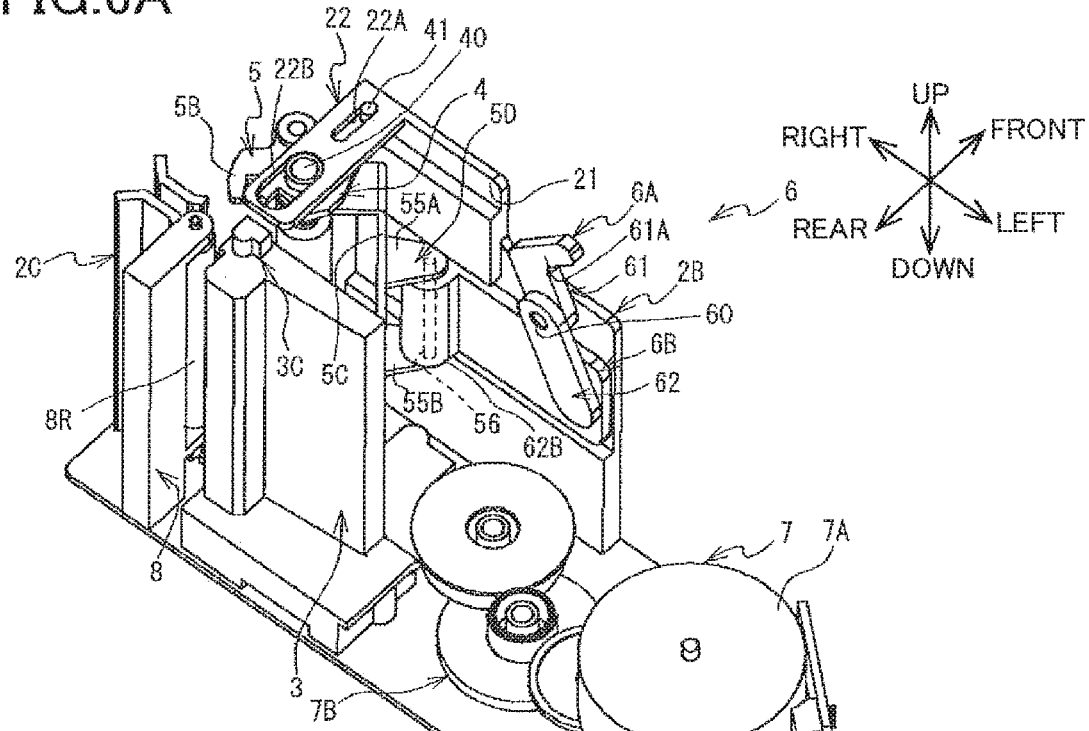
FIGS. 6A and 6B are perspective views of the frame (the first frame and the second frame), the head holder, the platen holder, the engagement member, and the moving mechanism viewed from a rear left side thereof.

As illustrated in FIGS. 5A and 5B, the arm 5D is provided in front of the side plate 5C. As illustrated in FIG. 6A, the arm 5D includes plates 55A, 55B and the second pin 56. Each of the plates 55A, 55B extends in a direction orthogonal to the side plate 5C. The second pin 56 is provided between distal end portions of the respective plates 55A, 55B which are located on an opposite side from the side plate 5C. The second pin 56 extends in the up and down direction and is engaged with a second engaging hole 64 of the moving mechanism 6 (see FIGS. 5A and 5B) which will be described below.

Moving Mechanism 6

Figure 6B:
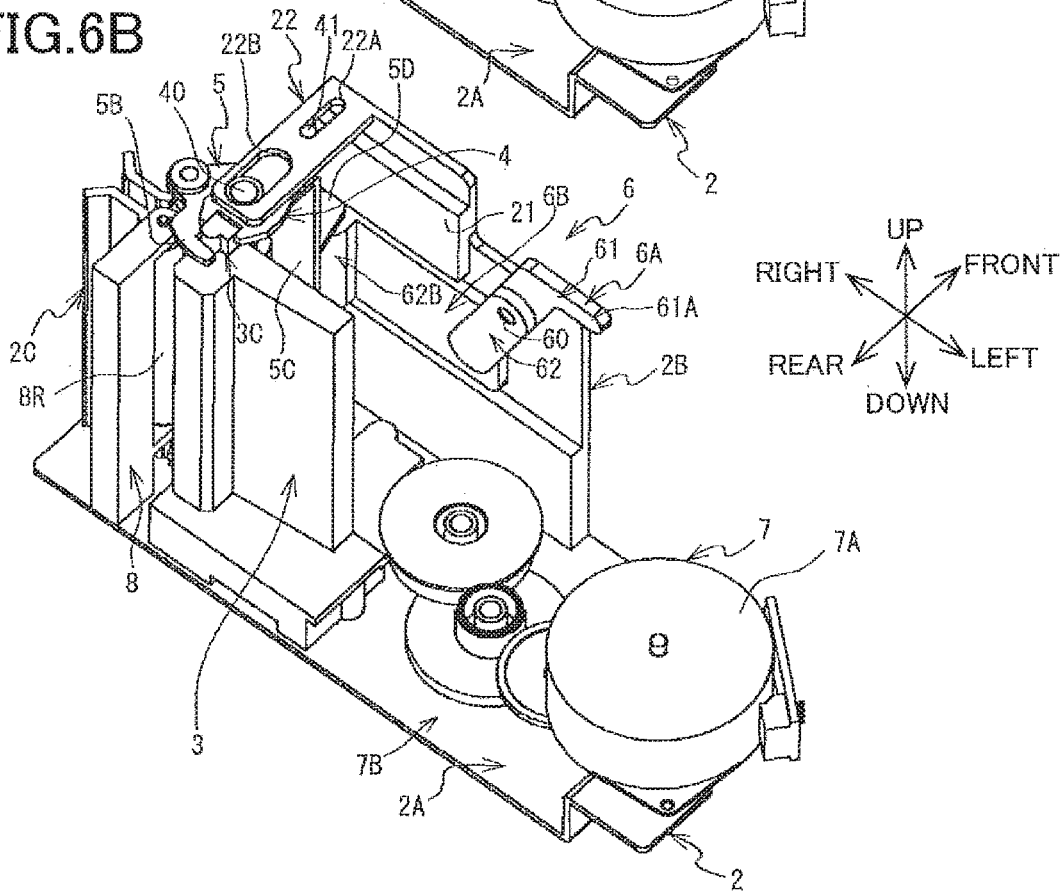

In response to opening and closing of the top cover 1B, the moving mechanism 6 moves the platen holder 4 between the separated position and the pressing position and moves the engagement member 5 between the disengaged position and the engaged position. As illustrated in FIGS. 6A and 6B, the moving mechanism 6 is disposed on a rear side of the front plate 21 of the second frame 2B and on a front side of the head holder 3, the platen holder 4, and the engagement member 5. The moving mechanism 6 includes the first lever member 6A and the second lever member 6B (as one example of a moving member).

The first lever member 6A includes elongated plates 61, 62. A lower end portion of the plate 61 and an upper end portion of the plate 62 are integrally connected to each other. Each of the plates 61, 62 extends substantially in the up and down direction from an upper end portion of the plate 61 to a lower end portion of the plate 62. A through hole is formed in the plates 61, 62 so as to extend in the front and rear direction through portions of the plates 61, 62 which are connected to each other. A shaft 60 protruding rearward from the front plate 21 of the second frame 2B is inserted in the through hole formed in the plates 61, 62. The first lever member 6A is pivotably supported, at its central portion in a direction in which the first lever member 6A extends, by the shaft 60 protruding from the second frame 2B. FIGS. 3A-8A illustrate a state of the first lever member 6A rotated most in the clockwise direction when viewed from a front side. FIGS. 3B-8B illustrate a state of the first lever member 6A rotated most in the counterclockwise direction when viewed from a front side. A torsion spring, not illustrated, mounted on the shaft 60 urges the first lever member 6A in the clockwise direction when viewed from a front side.

The contact portion 61A is provided on the upper end portion of the plate 61 of the first lever member 6A. The contact portion 61A extends in a direction inclined leftward with respect to a direction in which the plate 61 extends. The contact portion 61A is contactable with the depressing portion 17 of the top cover 1B being in the closed state. As illustrated in FIGS. 5A and 5B, a circular cylindrical first pin 62A protruding frontward is provided on a front surface of the lower end portion of the plate 62 of the first lever member 6A. The first pin 62A is inserted, from a rear side, in a first engaging hole 63 formed in the second lever member 6B which will be described below.

As illustrated in FIGS. 5A and 5B, the second lever member 6B is shaped like a substantially rectangular plate extending in a direction orthogonal to the front and rear direction. The longitudinal direction of the second lever member 6B coincides with the right and left direction. As illustrated in FIGS. 3A and 3B, the second lever member 6B is fitted, from a rear side, in the groove 23 provided on the rear surface of the front plate 21 of the second frame 2B. The second lever member 6B is supported so as to be movable in the right and left direction along the groove 23. That is, the second lever member 6B is movable in the conveying direction. The frame 2 limits movement of the second lever member 6B such that the second lever member 6B is movable in the conveying direction. FIGS. 3A-8A illustrate a state of the second lever member 6B moved farthest in the left direction. FIGS. 3B-8B illustrate a state of the second lever member 6B moved farthest in the right direction. The position of the moving mechanism 6 illustrated in FIGS. 3A-8A will be hereinafter referred to as "non-acting position" (as one example of a first moving position of the moving member). The position of the moving mechanism 6 illustrated in FIGS. 3B-8B will be hereinafter referred to as "acting position" (as one example of a second moving position of the moving member). The moving mechanism 6 is movable between the non-acting position and the acting position. The torsion spring, not illustrated, mounted on the shaft 60 urges the moving mechanism 6 such that the moving mechanism 6 is kept at the non-acting position.

As illustrated in FIGS. 5A and 5B, the first engaging hole 63 is formed in a left end portion of the second lever member 6B. The first engaging hole 63 is elongated in the up and down direction and formed through the second lever member 6B in the front and rear direction. The first pin 62A of the first lever member 6A is inserted in the first engaging hole 63 from a rear side toward a front side thereof. As a result, the first pin 62A is engaged with the first engaging hole 63. An extending portion 62B extending rearward is provided on a rear surface of a right end portion of the second lever member 6B. The second engaging hole 64 extends through the extending portion 62B in the up and down direction. The second pin 56 provided on the arm 5D of the engagement member 5 is inserted in the second engaging hole 64. As a result, the second pin 56 is engaged with the second engaging hole 64. That is, the engagement member 5 is connected to the second lever member 6B so as to be pivotable about the central axis of the second pin 56 (as one example of a second pivot axis) with respect to the second lever member 6B. It is noted that a point on the engagement member 5 through which the pivotal center line 5X extends (as one example of a first point on the engagement member) and a point on the engagement member 5 through which the central axis of the second pin 56 extends (as one example of a second point on the engagement member) are spaced apart from each other at a predetermined distance. That is, the pivotal center line 5X about which the engagement member 5 pivots with respect to the platen holder 4, and the central axis of the second pin 56 about which the engagement member 5 pivots with respect to the second lever member 6B are parallel to each other and spaced apart from each other at the predetermined distance.

Drive Mechanism 7

The drive mechanism 7 drives and rotates the platen roller 4R and the sub-roller 5R to convey the laminate tape M, the ink ribbon, and the adhesive tape in the conveying direction. As illustrated in FIGS. 3A-4B, the drive mechanism 7 includes a motor 7A and a gear mechanism 7B including a plurality of gears. The gear mechanism 7B transmits a rotational driving force generated by the motor 7A, to the platen roller 4R and the sub-roller 5R.

Figure 7B:
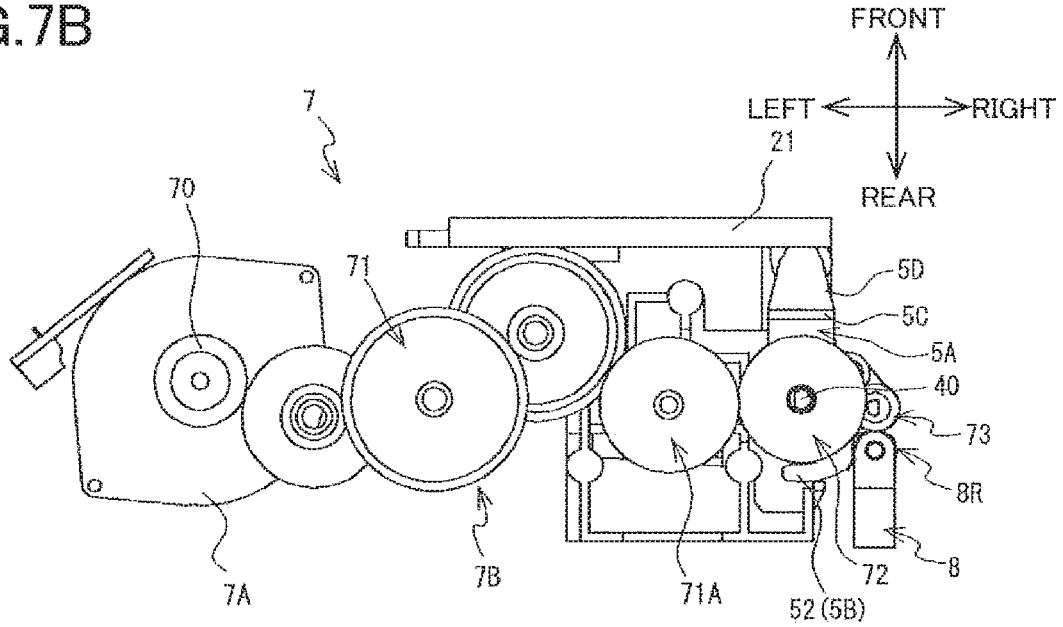

As illustrated in FIGS. 7A and 7B, the gear mechanism 7B includes a second gear 72, a third gear 73, and a gear train 71 including four gears. The motor 7A and the gear train 71 are provided on the first frame 2A of the frame 2. FIGS. 7A and 7B omit illustration of the first frame 2A for easier understanding purposes. The gears of the gear train 71 are arranged in the right and left direction. Each adjacent two of the gears of the gear train 71 are engaged with each other. The leftmost gear of the gear train 71 is engaged with a drive gear 70 provided on a rotation shaft of the motor 7A. The rightmost gear of the gear train 71 will be referred to as "first gear 71A". The second gear 72 is connected to the support shaft 40 of the platen roller 4R (see FIGS. 5A and 5B, for example). The third gear 73 is connected to the support shaft 50 of the sub-roller 5R (see FIGS. 5A and 5B, for example). While engaged with each other, the second gear 72 and the third gear 73 are moved in the front and rear direction in response to movement of the platen holder 4 and the engagement member 5 and moved in response to pivotal movement of the engagement member 5.

As illustrated in FIG. 7A, the first gear 71A is separated from the second gear 72 in the state in which the platen holder 4 is located at the separated position, and the engagement member 5 is located at the disengaged position. That is, the first gear 71A and the second gear 72 are not engaged with each other, and the rotational driving force generated by the motor 7A is not transmitted to the platen roller 4R and the sub-roller 5R. In contrast, as illustrated in FIG. 7B, the second gear 72 is located near the first gear 71A and engaged with the first gear 71A in the state in which the platen holder 4 is located at the pressing position, and the engagement member 5 is located at the engaged position. In this case, the rotational driving force generated by the motor 7A is transmitted to the platen roller 4R and the sub-roller 5R, so that the platen roller 4R and the sub-roller 5R are rotated.

Operations when Top Cover 1B is Closed

As illustrated in FIG. 2, when the top cover 1B is in the open state, the moving mechanism 6 is located at the non-acting position (see FIGS. 3A-8A), and the contact portion 61A of the first lever member 6A protrudes upward from the accommodating portion 16. When the moving mechanism 6 is located at the non-acting position, the platen holder 4 is located at the separated position, and the engagement member 5 is located at the disengaged position (see FIGS. 3A-8A). In this state, as illustrated in FIGS. 3A-8A, the platen roller 4R is separated from the head holder 3. The recessed portion 43 of the upper holder portion 4A is not engaged with the protruding portion 32A of the head holder 3, and the engaging claws 5B are not engaged with the respective engaging protrusions 32B of the head holder 3.

Figure 8A:
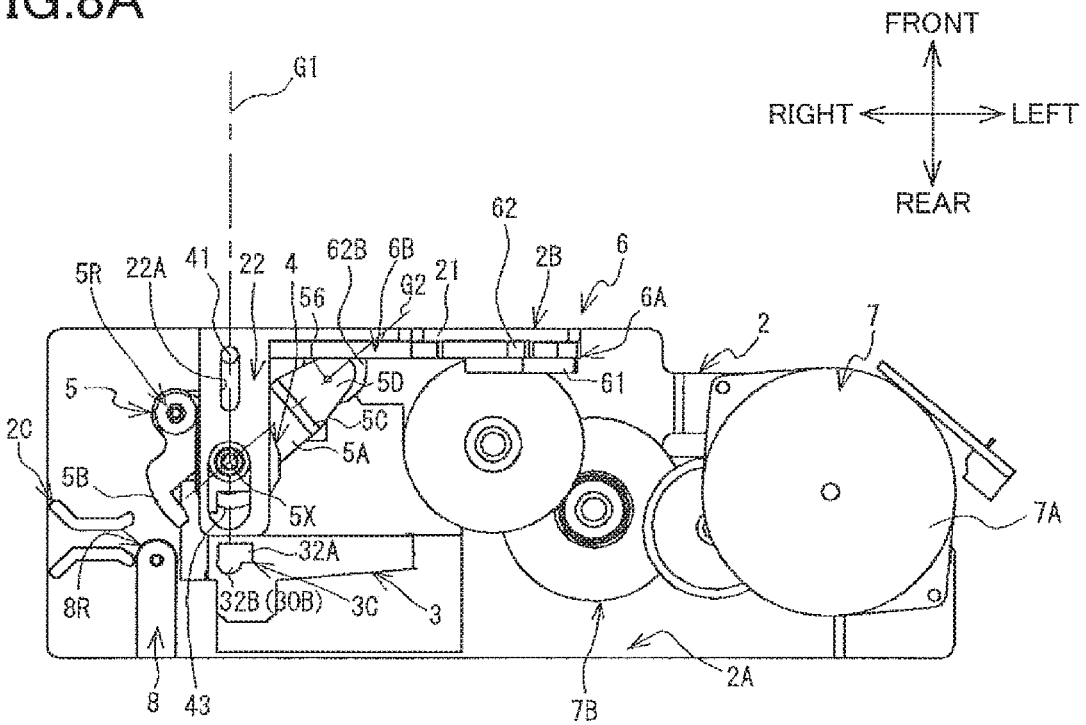
FIGS. 8A and 8B are views of the frame (the first frame and the second frame), the head holder, the platen holder, the engagement member, and the moving mechanism viewed from above.

As illustrated in FIG. 8A, an imaginary straight line, when viewed from above, extending in the front and rear direction through a point on the pivotal center line 5X as the pivotal center of the engagement member 5 (e.g., a point on the pivotal center line 5X of the engagement member 5) is defined as "first imaginary line G1". When the engagement member 5 located at the disengaged position is viewed from above, an imaginary straight line extending through the pivotal center line 5X and a point on the central axis of the second pin 56 of the engagement member 5 (e.g., a point on the central axis of the second pin 56 of the engagement member 5) is defined as "second imaginary line G2". The arm 5D of the engagement member 5 extends diagonally from the side plate 5C toward the second lever member 6B of the moving mechanism 6 in a front left direction along the second imaginary line G2. In other words, the arm 5D extends in a direction inclined leftward with respect to the front direction. The angle between the first imaginary line G1 and the second imaginary line G2 is about 50 degrees, for example.

In a process in which the top cover 1B is switched from the open state (see FIG. 2) to the closed state (see FIG. 1), the depressing portion 17 of the top cover 1B contacts the contact portion 61A of the first lever member 6A. Since the contact portion 61A extends toward an upper left side, a leftward pressing force is applied from the top cover 1B to the contact portion 61A. As illustrated in FIGS. 5A and 5B, the first lever member 6A pivots about the shaft 60, against the urging force of the torsion spring, not illustrated, mounted on the shaft 60, in a direction in which the contact portion 61A is moved leftward (FIG. 5A to FIG. 5B). The first pin 62A of the first lever member 6A is moved in the right direction (i.e., the conveying direction) in response to pivotal movement of the first lever member 6A. When the first pin 62A is moved, a rightward force acts on the second lever member 6B via the first engaging hole 63 engaged with the first pin 62A. The second lever member 6B is moved in the right direction (i.e., the conveying direction) along the groove 23 formed in the second frame 2B of the frame 2 (see FIGS. 3A and 3B). This movement moves the moving mechanism 6 from the non-acting position to the acting position (FIG. 5A to FIG. 5B). That is, the second lever member 6B is moved from the non-acting position to the acting position in conjunction with switching of the top cover 1B from the open state to the closed state. In this movement, the contact portion 61A of the first lever member 6A is rotated leftward and thereby enters into a space formed between the depressing portion 17 and the raising portion 18 of the top cover 1B.

When the second lever member 6B is moved in the right direction, the position of the second engaging hole 64 of the extending portion 62B is moved in the right direction (i.e., the conveying direction). When the second engaging hole 64 is moved, the second pin 56 engaged with the second engaging hole 64 is also moved rightward. A force directed toward a rear right side along the second imaginary line G2 along which the arm 5D extends acts on the arm 5D connected to the second pin 56. That is, when the second lever member 6B is moved from the non-acting position to the acting position, the second lever member 6B applies a force containing a rearward component to the engagement member 5. The force applied from the second lever member 6B to the engagement member 5 is based on a force that is applied from the frame 2 to the second lever member 6B when the second lever member 6B is moved in the conveying direction along the groove 23 formed in the frame 2.

Figure 8B:
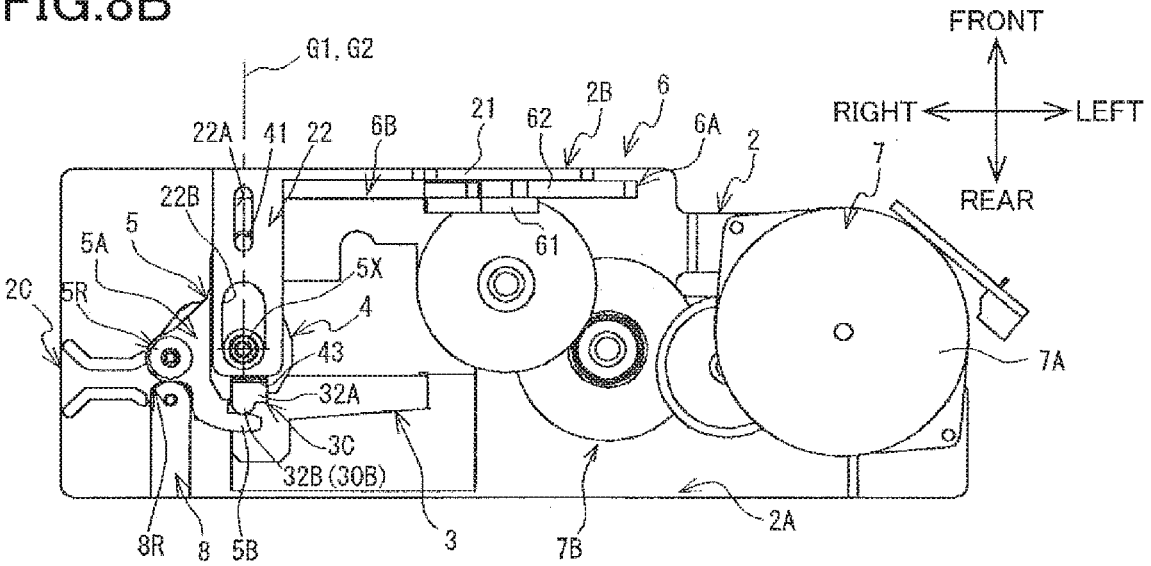

In response to a force corresponding to a rightward component of the force acting on the arm 5D, the engagement member 5 pivots about the pivotal center line 5X in the counterclockwise direction when viewed from above. That is, the engagement member 5 pivots about the pivotal center line 5X with respect to the platen holder 4. At the same time, the engagement member 5 pivots about the second pin 56 with respect to the second lever member 6B in the counterclockwise direction when viewed from above. As a result, the engagement member 5 is moved from the disengaged position to the engaged position (FIG. 5A to FIG. 5B). As illustrated in FIG. 8B, the angle between the first imaginary line G1 and the second imaginary line G2 gradually decreases, and the first imaginary line G1 and the second imaginary line G2 finally coincide with each other. That is, the angle between the first imaginary line G1 and the second imaginary line G2 becomes zero degrees. That is, the angle between the first imaginary line G1 and the second imaginary line G2 when the second lever member 6B is located at the acting position is less than the angle between the first imaginary line G1 and the second imaginary line G2 when the second lever member 6B is located at the non-acting position.

In response to a force corresponding to a rearward component of the force acting on the arm 5D, the engagement member 5 presses the platen holder 4 rearward via the support shaft 40. That is, when the second lever member 6B is moved from the non-acting position to the acting position, the engagement member 5 applies a force containing a rearward component to the platen holder 4. As a result, as illustrated in FIGS. 3A, 3B, 5A, and 5B, the upper holder portion 4A is moved rearward along the elongated holes 22A, 22B of the upper plate 22, and the lower holder portion 46 is moved rearward along the guide groove 36A. As thus described, the platen holder 4 is moved from the separated position to the pressing position. The platen roller 4R supported by the platen holder 4 is located at a rear of and near the thermal head 3B of the head holder 3. The laminate tape M and the ink ribbon are nipped between the platen roller 4R and the thermal head 3B in the state in which the cassette 9 is mounted in the accommodating portion 16. The sub-roller 5R supported by the engagement member 5 is located in front of and near the sticking roller 8R. In the state in which the cassette 9 is mounted in the accommodating portion 16, the laminate tape M and the adhesive tape are nipped between the sub-roller 5R and the sticking roller 8R, and the sub-roller 5R sticks the adhesive tape to the laminate tape M.

As illustrated in FIG. 4, when the platen holder 4 is moved from the separated position to the pressing position, the recessed portion 43 of the upper holder portion 4A is engaged with the protruding portion 32A of the head holder 3 (FIG. 4A to FIG. 4B). As illustrated in FIGS. 5A and 5B, when the engagement member 5 is moved from the disengaged position to the engaged position in conjunction with movement of the platen holder 4, the engaging claws 5B are moved to the respective engaging protrusions 32B of the head holder 3 from a right side thereof and engaged with rear end portions of the respective engaging protrusions 32B (FIG. 5A to FIG. 4B).

When the motor 7A of the drive mechanism 7 is rotated, the rotational driving force is transmitted to the platen roller 4R and the sub-roller 5R via the gear mechanism 7B. When the platen roller 4R is rotated, the laminate tape M and the ink ribbon nipped between the platen roller 4R and the thermal head 3B are conveyed in the conveying direction. At the same time, the thermal head 3B is heated to transfer the ink of the ink ribbon to the laminate tape M. Also, rotation of the sub-roller 5R conveys, in the conveying direction, the laminate tape M and the adhesive tape nipped between the sub-roller 5R and the sticking roller 8R. The printed tape in which the adhesive tape is stuck to the printed laminate tape is discharged through the output opening 13 via the output unit 2C.

Operations when Top Cover 1B is Opened

When the top cover 1B is switched from the closed state (see FIG. 1) to the open state (see FIG. 2), the raising portion 18 of the top cover 1B moves the contact portion 61A of the first lever member 6A upward. The first lever member 6A is rotated about the shaft 60 in such a direction that the contact portion 61A is moved rightward. In this rotation, the urging force of the torsion spring, not illustrated, mounted on the shaft 60 acts in a direction in which the urging force assists the first lever member 6A in rotating. The rotation of the first lever member 6A moves the second lever member 6B leftward. As a result, the moving mechanism 6 is moved from the acting position to the non-acting position (FIG. 5B to FIG. 5A). In the middle of opening of the top cover 1B, the contact portion 61A of the first lever member 6A is separated rightward from a right end of the raising portion 18.

When the second lever member 6B is moved leftward, the second pin 56 engaged with the second engaging hole 64 is also moved leftward. The engagement member 5 pivots about the pivotal center line 5X when the second pin 56 is moved. As a result, the engagement member 5 is moved from the engaged position back to the disengaged position (FIG. 5B to FIG. 5A). When the engagement member 5 is moved from the engaged position to the disengaged position, the upper holder portion 4A is moved frontward along the elongated holes 22A, 22B formed in the upper plate 22. The lower holder portion 46 is moved frontward along the guide groove 36A. As a result, the platen holder 4 is moved from the pressing position back to the separated position (FIG. 5B to FIG. 5A).

Effects

The moving mechanism 6 of the printer 1 moves the engagement member 5 from the disengaged position to the engaged position when the platen holder 4 is moved from the separated position to the pressing position. That is, the engagement member 5 is engaged with the head holder 3 when the platen holder 4 is located at the pressing position. This configuration stabilizes the position of the platen roller 4R with respect to the thermal head 3B. The moving mechanism 6 is capable of moving both of the platen holder 4 and the engagement member 5. This configuration enables the user to easily perform an operation for establishing a printable state of the printer 1.

The engagement member 5 pivots from the disengaged position to the engaged position to engage the engaging claws 5B with the respective engaging protrusions 32B of the head holder 3. This configuration easily engages the engagement member 5 with the head holder 3, making it possible to stabilize the position of the platen roller 4R with respect to the thermal head 3B. The engaging claws 5B are brought into contact and engaged with the rear end portions of the respective engaging protrusions 32B from a rear side thereof. Thus, even in the case where a force acts on the platen holder 4 in a direction away from the thermal head 3B, it is possible to reliably keep a state in which the platen roller 4R is close to the thermal head 3B.

The center line 4X of the support shafts 40 of the platen holder 4 and the pivotal center line 5X of the engagement member 5 are located on the same straight line. That is, the rotation center (i.e., the center line 4X) of the platen roller 4R and the pivotal center (i.e., the pivotal center line 5X) of the engagement member 5 are located on the same line. This configuration reduces a space in which the platen holder 4 and the engagement member 5 are disposed, resulting in reduced size of the printer 1. The position of the pivotal center (i.e., the pivotal center line 5X) of the engagement member 5 is the same as the rotation center (i.e., the center line 4X) of the platen roller 4R, making it possible for the engagement member 5 to stably keep the position of the platen roller 4R with respect to the head holder 3. This further stabilizes the position of the platen roller 4R with respect to the thermal head 3B.

The engaging claws 5B include the pair of claws 53. The claws 53 are engaged with the respective protruding portions 30B provided on the respective upper and lower surfaces of the head supporter 3A of the head holder 3. That is, the engagement member 5 is engaged with the head holder 3 at upper and lower portions of the platen roller 4R. Thus, the printer 1 can keep the position of the platen roller 4R with respect to the thermal head 3B uniformly in the up and down direction. This makes it possible to accurately stabilize the position of the platen roller 4R with respect to the thermal head 3B.

The sub-roller 5R is located downstream of the platen roller 4R in the conveying direction and configured to stick the adhesive tape to the laminate tape M and convey the adhesive tape and the laminate tape M. Here, the sub-roller 5R is rotatably supported by the engagement member 5. That is, the printer 1 uses the engagement member 5 as a configuration for supporting the sub-roller 5R. Accordingly, it is possible to reduce a space in which the sub-roller 5R is disposed, resulting in reduced size of the printer 1.

When the platen holder 4 is moved from the separated position to the pressing position, the recessed portion 43 of the upper holder portion 4A is moved to and engaged with the protruding portions 32A of the head holder 3 from a front side thereof. This configuration can keep the position of the platen roller 4R with respect to the thermal head 3B, to a regular position. The right end surface of the protruding portion 32A contacts the right end surface of the recessed portion 43, and the left end surface of the protruding portion 32A contacts the left end surface of the recessed portion 43. In this case, the protruding portion 32A of the head holder 3 can receive a force in the conveying direction which acts on the platen holder 4 in a process in which the laminate tape M is conveyed in the conveying direction. This stabilizes a positional relationship of the platen roller 4R with respect to the thermal head 3B in the conveying direction.

The moving mechanism 6 is moved from the non-acting position to the acting position when the top cover 1B is switched from the open state to the closed state. The movement of the moving mechanism 6 moves the platen holder 4 from the separated position to the pressing position and moves the engagement member 5 from the disengaged position to the engaged position. This configuration stabilizes the position of the platen roller 4R with respect to the thermal head 3B in response to an operation for closing the top cover 1B.

When the moving mechanism 6 is moved from the non-acting position to the acting position, the engagement member 5 is moved from the disengaged position to the engaged position, and the platen holder 4 is moved from the separated position to the pressing position. The moving mechanism 6 has a simple configuration in which the moving mechanism 6 is constituted by the first lever member 6A and the second lever member 6B, making it possible to move both of the platen holder 4 and the engagement member 5 at the same time. When the moving mechanism 6 is moved, the angle between the first imaginary line G1 and the second imaginary line G2 gradually decreases and finally becomes zero degrees. It is noted that a reaction force received by the second lever member 6B when the moving mechanism 6 moves the platen holder 4 and the engagement member 5 corresponds to a component, in a direction orthogonal to the first imaginary line G1, of a force acting along the second imaginary line G2. That is, the reaction force decreases with decrease in the angle between the first imaginary line G1 and the second imaginary line G2. Thus, the printer 1 reduces a force required for moving the engagement member 5 and the platen holder 4. Accordingly, in the case where the configuration of the moving mechanism 6 is simplified, it is possible to appropriately move the engagement member 5 and the platen holder 4.

Modifications

While the embodiment has been described above, it is to be understood that the disclosure is not limited to the details of the illustrated embodiment, but may be embodied with various changes and modifications, which may occur to those skilled in the art, without departing from the spirit and scope of the disclosure. The printing type of the printer 1 is not limited to the thermal transfer type and may be a thermal type in which the thermal head 3B heats a thermal paper sheet to perform color development. The direction in which the platen holder 4 is movable may not be the front and rear direction and may be a direction inclined with respect to the front and rear direction. In the above-described embodiment, the supporters 5A of the engagement member 5 are pivotably supported by the respective support shafts 40 of the platen roller 4R. In contrast, the supporters 5A of the engagement member 5 may be pivotably supported by the platen holder 4. The center line 4X of the support shafts 40 of the platen holder 4 and the pivotal center line 5X of the engagement member 5 may not coincide with each other. A supporter for supporting the engagement member 5 pivotably may be provided at a position different from the center line 4X of the support shafts 40 of the platen holder 4.

A manner of engagement of the claws 53 of the engagement member 5 with respect to the respective protruding portions 30B of the head holder 3 is not limited to that in the above-described embodiment. For example, grooves may be formed in right end portions of the respective protruding portions 30B of the head holder 3. The claws 53 of the engagement member 5 may be fitted on the respective protruding portions 30B by being fitted in the grooves of the respective protruding portions 30B from a right side thereof. The engagement member 5 may include only one of the claws 53 (the claw 51 or the claw 52). The head holder 3 may include only one of the engaging protrusions 32B which corresponds to one of the claws 53.

The sub-roller 5R may be supported by the platen holder 4 instead of being supported by the engagement member 5. When the platen holder 4 is moved from the separated position to the pressing position, the sub-roller 5R may be moved toward the sticking roller 8R from a front side thereof to nip the laminate tape M and the adhesive tape with the sticking roller 8R. The printer 1 may not include the sub-roller 5R. For example, the cassette 9 may include a roller corresponding to the sub-roller 5R and opposed to the sticking roller 8R in the state in which the cassette 9 is accommodated in the accommodating portion 16.

In the state in which the recessed portion 43 of the upper holder portion 4A is engaged with the protruding portion 32A of the head holder 3, only the right end surface of the protruding portions 32A may contact the right end surface of the recessed portion 43, or only the left end surface of the protruding portions 32A may contact the left end surface of the recessed portion 43. The printer 1 may be configured such that a protruding portion protruding toward the head holder 3 is provided at a rear end portion of the platen holder 4, and a recessed portion recessed away from the platen holder 4 is formed in a front end portion of the projecting portion 3C of the head holder 3. In this case, when the platen holder 4 is moved from the separated position to the pressing position, the protruding portion of the platen holder 4 may be engaged with the recessed portion of the head holder 3.

In the above-described embodiment, in the process in which the top cover 1B is switched to the closed state, the first lever member 6A comes into contact with the top cover 1B, and the moving mechanism 6 is moved from the non-acting position to the acting position. In contrast, the operations for opening and closing the top cover 1B and the movement of the moving mechanism 6 may not be related to each other. For example, the first lever member 6A may be manually operated by the user. The manual operation of the first lever member 6A may move the moving mechanism 6 between the non-acting position and the acting position.

The cassette 9 is a tape cassette using a laminate tape but may be a tape cassette not using a laminate tape, such as a tape cassette that uses an ink ribbon to perform printing on a substrate tape, and a tape cassette that uses a thermal substrate tape. In this case, the substrate tape is one example of the printing medium.

Associations

Each of the support shafts 50 is one example of a support shaft. Each of the supporters 5A is one example of a supporter. The up and down direction is one example of a first direction. The front and rear direction is one example of a second direction.

What is claimed is:

1. A printer, comprising:

a head holder configured to support a thermal head configured to perform printing on a printing medium;

a platen holder configured to support a platen roller such that the platen roller is rotatable about a support shaft extending in a first direction orthogonal to a conveying direction in which the printing medium is conveyed during printing, the platen roller being configured to press the printing medium toward the thermal head, the platen holder being movable in a second direction orthogonal to the first direction and intersecting the conveying direction;

an engagement member movably supported by one of the platen holder and the platen roller and engageable with and removable from the head holder; and a moving mechanism configured to move the platen holder and the engagement member and configured to move the engagement member from a disengaged position at which the engagement member is separated from and not engaged with the head holder, to an engaged position at which the engagement member is located at and engaged with the head holder, in conjunction with moving the platen holder in the second direction from a separated position at which the platen roller is separated from the head holder, to a pressing position at which the platen roller presses the printing medium against the thermal head.

2. The printer according to claim 1, wherein the engagement member comprises:

a supporter pivotably supported by one of the platen holder and the platen roller; and an engaging claw engageable with an engaging protrusion provided on the head holder.

3. The printer according to claim 2, wherein a pivot axis of the engagement member extends in the first direction, and the pivot axis of the engagement member and a central axis of the support shaft are located on an identical line.

4. The printer according to claim 2, wherein the engaging claw comprises a pair of claws provided respectively on opposite sides of the platen roller in the first direction, and wherein the engaging protrusion comprises a pair of protruding portions to be engaged respectively with the pair of claws.

5. The printer according to claim 1, wherein the engagement member supports a sub-roller such that the sub-roller is rotatable, and wherein the sub-roller is capable of conveying the printing medium at a position located downstream of the platen roller in the conveying direction in a state in which the engagement member is located at the engaged position.

6. The printer according to claim 1, wherein the platen holder comprises a recessed portion recessed from a pressing-position side toward a separated-position side in the second direction, wherein the head holder comprises a protruding portion that is engaged with the recessed portion in a state in which the platen holder is located at the pressing position, and wherein the recessed portion comprises an upstream wall and a downstream wall in the conveying direction, and at least one of the upstream wall and the downstream wall contacts the protruding portion in a state in which the protruding portion is engaged with the recessed portion.

7. The printer according to claim 1, further comprising:

an accommodating portion in which a cassette storing the printing medium is mountable; and a top cover switchable between an open state in which the accommodating portion is open and a closed state in which the accommodating portion is closed, wherein the moving mechanism is configured to move the platen holder from the separated position to the pressing position and move the engagement member from the disengaged position to the engaged position in conjunction with switching the top cover from the open state to the closed state.

8. The printer according to claim 7, wherein the moving mechanism comprises:

a first lever member comprising (i) a first end portion provided with a contact portion contactable with the top cover, (ii) a second end portion provided with a first pin extending in the second direction, and (iii) a substantially central portion supported by a frame such that the first lever member is pivotable; and a second lever member comprising (a) a first engaging hole through which the first pin extends and with which the first pin is engaged, (b) an extending portion comprising a second engaging hole extending in the first direction, the second lever member being supported by the frame so as to be movable in the conveying direction and a direction reverse to the conveying direction, wherein the platen holder is supported by the frame so as to be movable in the second direction, wherein the engagement member comprises:

an arm supported pivotably with respect to the frame and movably in the second direction and extending toward the second lever member from a supporter pivotably supported by one of the platen holder and the platen roller; and a second pin provided on a distal end portion of the arm, being engageable with the second engaging hole, and extending in the first direction, wherein the first pin is configured to, when the top cover is switched from the open state to the closed state, be moved in the conveying direction by pivotal movement of the first lever member which is caused by pressing of the top cover against the contact portion of the first lever member, wherein the second lever member is configured to be moved in the conveying direction via the first engaging hole by movement of the first pin in the conveying direction, wherein the second pin of the engagement member is configured to be moved in the conveying direction via the second engaging hole by movement of the second lever member in the conveying direction, and wherein when the second pin of the engagement member is moved in the conveying direction, an angle between a first imaginary line extending in the second direction and a second imaginary line extending through a point on a pivot axis of the engagement member and through a point on a central axis of the second pin decreases, the engagement member is moved from the disengaged position to the engaged position, and the platen holder is moved from the separated position to the pressing position.

9. The printer according to claim 1, wherein the platen holder is movable in the second direction with respect to the head holder, wherein the engagement member is supported by the platen holder via a shaft so as to be pivotable with respect to the platen holder about a first pivot axis extending through a first point on the engagement member, wherein the moving mechanism comprises a moving member movable in the conveying direction between a first moving position and a second moving position located downstream of the first moving position in the conveying direction, wherein the engagement member is connected to the moving member so as to be pivotable about a second pivot axis extending through a second point on the engagement member which is different in position from the first point, and wherein the platen holder is moved in the second direction in conjunction with movement of the moving member in the conveying direction from the first moving position to the second moving position.

10. The printer according to claim 9, wherein the engagement member is configured to pivot with respect to both of the platen holder and the moving member in conjunction with movement of the moving member in the conveying direction from the first moving position to the second moving position.

11. The printer according to claim 9, further comprising a frame configured to secure the head holder, wherein the frame comprises a conveying-direction-movement limiter configured to limit movement of the moving member such that the moving member is moved in the conveying direction between the first moving position and the second moving position.

12. The printer according to claim 9, further comprising a frame configured to secure the head holder, wherein the frame comprises a second-direction-movement limiter configured to limit movement of the platen holder such that the platen holder is moved in the second direction.

13. The printer according to claim 9, wherein the engagement member is configured to apply a force containing a component in the second direction, to the platen holder when the moving member is moved from the first moving position to the second moving position in the conveying direction.

14. The printer according to claim 11, wherein when the moving member is moved from the first moving position to the second moving position in the conveying direction, the conveying-direction-movement limiter applies a force containing a component in the second direction, to the moving member, and the moving member applies a force containing a component in the second direction, to the engagement member.

15. The printer according to claim 9, wherein the first pivot axis of the engagement member extends in the first direction, and the first pivot axis of the engagement member and a central axis of the support shaft are located on an identical line.

16. The printer according to claim 9, wherein an angle between a first imaginary line extending parallel with the second direction and a second imaginary line extending through the first point and the second point when the moving member is located at the second moving position is less than an angle between the first imaginary line and the second imaginary line when the moving member is located at the first moving position.

17. The printer according to claim 9, further comprising:

an accommodating portion in which a cassette storing the printing medium is mountable; and a top cover switchable between an open state in which the accommodating portion is open and a closed state in which the accommodating portion is closed, wherein the moving member is configured to be moved from the first moving position to the second moving position in conjunction with switching the top cover from the open state to the closed state.

* * * * *